United States Patent [19]

Seydel et al.

[11] Patent Number: 4,656,705

[45] Date of Patent: Apr. 14, 1987

[54] TEXTILE SLASHER LUBRICATING METHOD

[76] Inventors: Scott O. Seydel, 80 Broad St., N.W., Atlanta, Ga. 30303; William H. Cutts, P.O. Box 748, Clemson, S.C. 29631

[21] Appl. No.: 727,868

[22] Filed: Apr. 26, 1985

Related U.S. Application Data

[63] Continuation-in-part of Ser. No. 308,449, Oct. 5, 1981, Pat. No. 4,513,485.

[51] Int. Cl.[4] ..... D02H 5/02

[52] U.S. Cl. ..... 28/179; 28/185; 118/234; 118/266

[58] Field of Search ..... 28/178, 179, 180, 181, 28/185; 118/234, 266

[56] References Cited

U.S. PATENT DOCUMENTS

| | | | |
|---|---|---|---|
| 2,402,652 | 6/1946 | Martin | 28/179 |
| 2,795,839 | 6/1957 | Seawell | 28/179 |
| 2,982,001 | 5/1961 | O'Shields | 28/180 |
| 3,157,536 | 11/1964 | Caines . | |
| 3,280,441 | 10/1966 | Cocker III | 28/179 |
| 3,306,254 | 2/1967 | Keith . | |
| 3,406,437 | 10/1968 | Tew | 28/181 X |
| 3,449,808 | 6/1969 | Kuroda | 28/180 |
| 4,025,993 | 5/1977 | Kuroda | 28/181 |
| 4,364,157 | 12/1982 | Cutts | 28/179 |
| 4,513,485 | 4/1985 | Cutts et al. | 28/181 |

OTHER PUBLICATIONS

Cutts et al. "Development of a New Method for the Application of Warp Sizing", The World Conference of Sizing, Part Two, pp. 24—41, Clemson University, Mar. 24—28, 1982.

Seydel, "The State of the Art in Warp Sizing", America Textiles, pp. 20, 24, 50, (Mar. 1984).

*Primary Examiner*—Robert R. Mackey

*Attorney, Agent, or Firm*—Cort Flint

[57] ABSTRACT

The invention relates to a method of lubricating warp yarn ends arranged in sheet form (W) on the dry side of the drying process (16) as part of the process of preparing a loom beam (22) on a slasher. The method comprises providing a pair of rotating porous lubricating rods (40, 42) arranged on a frame (44, 46) attached to a frame portion (88) of the slasher. The rotating porous rods are provided in the form of a hollow rod having an after lubricant surface (B), an inner lubricant distribution layer A, and a boundary region (32) in which a flow control membrane (C) is formed. The above described construction provides a highly accurate flow control and metering of the lubricant from the interior of the rod outwardly to the application surface. The porous construction of the rods (40, 42) makes them particularly advantageous for employment in a rotating appartus when the warp yarn sheet (W) passes through in a serpentine configuration to contact both sides of the warp yarn sheets with the staggered rotating lubricating rods. The method is particularly advantageous for lubricating a warp yarn sheet (112) in a complex configuration wherein two individual warp yarn sheets contact each other without intermeshing.

10 Claims, 7 Drawing Figures

TEXTILE SLASHER LUBRICATING METHOD

CROSS-REFERENCE TO RELATED APPLICATION

This application is a continuation-in-part of application Ser. No. 06/308,449 of Oct. 5, 1981, now U.S. Pat. No. 4,513,485 granted Apr. 30, 1985.

BACKGROUND OF THE INVENTION

In the slashing process carried out on a typical textile slasher, individual warp yarn ends are withdrawn from one or more warp section beams to form a warp yarn sheet comprising warp yarns arranged generally side by side. The warp yarn sheet is subjected to a sizing process wherein a size is applied to the yarns for better strength and adherence. Next, the sheet of warp yarns is subjected to a drying process wherein the warp yarn sheet may be split into two or more warp yarn sheets and passed through a dryer oven which typically includes heated cylinders over which the warp yarn sheets pass. Next, the warp yarn sheets are subjected to a process wherein the warp yarn sheet is busted into the number of sheets corresponding generally to the number of section beams. The warp yarn sheets are brought back together and pass through a combing process. The combed warp ends are wound upon a loom beam which is then transported to a loom for weaving. Application of a lubricant to the warp yarn ends in sheet form has also been an optional step in the slashing process.

In the lubricating methods and apparatus theretofore utilized, one method has been to add waxes and other lubricants directly to the size box where they are mixed with the size solution. However, waxes and lubricants applied in this manner degrade the strength of the size film. The waxes are difficult to remove during the desizing and finishing of the woven fabric.

Kiss rolls have been utilized after the drying process to apply a wax or lubricant to the warp ends by passing the sheet horizontally over a roll partially immersed in a melted wax or other fluid lubricant. The wax must be heated in the reservoir requiring various accessory equipment and energy expenditures. The problem further occurs with the kiss roll type of application that the warp yarn sheet must be oriented horizontally in order to contact the kiss roll since it is immersed in an open top tank. Application of wax or lubricant by means of a kiss roll has resulted in excessive amounts of wax or lubricant being applied to the warp yarn sheets. Often, particularly in the case of filament yarns, the loom beam becomes saturated with the lubricant which drips during formation and utilization.

It has also been known to apply a lubricant with a kiss-roll type applicator prior to the drying process while the sizing is still relatively wet on the yarns. However, this results in the lubricant and wet sizing being mixed together somewhat wherein the advantageous effects of the sizing and the lubricant are somewhat reduced as described above.

Numerous rods and other types of devices have been heretofore proposed for applying various material to various strands. For example, in U.S. Pat. No. 3,306,254 a pair of rotating cylindrical members are disclosed which consist of a plurality of metal disks fitted together. A fluid plasticizer is applied to the cylindrical members which flows between the disks for application to cigarette tow passing over and under the applicator assemblies. While this device may be suitable for the application of a plasticizer to cigarette tow, it would not appear suitable for application of a fluid to warp yarn ends in a slashing process. The grooves defined between the various washers fitted together would not provide a sufficiently smooth and continuous surface over which to pass warp yarn ends for the application of a lubricant. In particular, fine denier yarn ends would easily become caught in the grooves resulting in breakage.

U.S. Pat. No. 3,157,536 discloses a pair of rods having a slit and wrapped by a stainless steel wire mesh for application of a plasticizer to cigarette tow. Tow in the form of a ½ inch wide ribbon is passed over and under stationary applicators. The tow is then coiled into a cylindrical form and fed to an air jet. This construction would not lend itself to lubricating warp ends nor to a rotating lubricating rod apparatus and method.

U.S. Pat. No. 4,268,550 discloses the application of a metered finish to a high speed yarn, and U.S. Pat. No. 3,553,006 discloses the fluid treatment of a yarn by passing the yarn underneath a porous plug which retains a film of the fluid. These devices are proposed for the fluid treatment of a single strand and are not suited as a method or apparatus for treating a warp yarn sheet composed of a plurality of individual warp ends.

British Pat. No. 23,955 discloses a felt dampening roller having a hollow interior into which water may be delivered. Warp yarns pass over the roll for dampening or conditioning the yarns in a warping and beaming machine. Again, discontinuities created by adjoining disk elements create problems in the passage of warp ends as would the nature of the felt fabric itself.

The above mentioned patents disclose various apparatus for applying various fluids to one or more yarn ends. The provision of a satisfactory method for lubricating yarns during a slashing process in such a manner that the individual warp yarn ends receive lubricant on at least one side thereof in an accurately metered amount to increase weaving efficiency which will not be excessive and will not cause pooling and dripping from the loom beam is a problem to which considerable attention need be given.

This is a continuation-in-part application of patent application Ser. No. 308,449 entitled Method and Apparatus for Splitting Textile Warp Yarn Sheets filed on Oct. 5, 1981. In this patent application, the use of a porous rod was disclosed in a method for splitting wet warp yarn sheets without sticking to the rod. An amount of lubricant was applied to the surface of the rod in order to prevent sticking of the warp ends to the rod. While some lubricant may reach the yarn, which may even be beneficial, it is not excessive to the extent that the yarns are considered lubricated in the ordinary sense. In the conventional slashing process, it has been found that lubricating the warp ends at the wet side of the dryer is often detrimental. The size is still wet and the lubricant can combine with the size to interfere with its function and with the later drying process. Neither the size nor lubricant tend to stay on well.

A proper amount of lubricant increases the weaving by reducing friction between the warp ends and loom parts which contact one another. Excessive lubricant causes build-ups on the loom parts such as heddle eyes, reed dents, etc., causing gumming. Too little lubricant decreases the efficiency of weaving due to warp end breakage caused by friction and catching of hairs not laid down. There is a clear need to put a precise amount of lubricant on the warp ends.

Accordingly, an important object of the present invention is to provide a method for lubricating individual warp yarn ends arranged generally side by side in a warp yarn sheet during a slashing process by applying a precisely controlled metered amount of lubricant.

Still another important object of the present invention is to provide a method of applying a metered amount of lubricant to at least one side of individual warp yarn ends arranged in a warp yarn sheet following the steps of sizing and drying the warp yarn ends.

Still another important object of the present invention is to provide a method of applying a lubricant to warp yarn ends arranged in a complex configuration wherein the warp yarn sheets contact one another on one side only without intermeshing of the warp yarn ends leaving one exposed side of each warp yarn sheet wherein the exposed side of each warp yarn sheet is lubricated while the sheets travel side by side.

Still another important object of the present invention is to provide a method and apparatus for applying a metered amount of lubricant to individual warp yarn ends in a slashing process wherein rotating porous lubricating rods are provided having a continuous porous application surface and lubricant distribution layer through which the flow of lubricant is controlled by means of a flow control membrane having its pore size determined in such manner as to control the flow of lubricant at predetermined slasher speeds and to apply a predetermined amount of lubricant to the individual warp yarn ends.

SUMMARY OF THE INVENTION

The above objectives are accomplished according to the present invention by providing a pair of rotating lubricating rolls in the form of a porous hollow roll having a porous lubricant distribution layer terminating in a continuous lubricant application surface presenting a smooth uninterrupted surface facilitating passage and lubricating of warp ends, even of the finest denier. An inner flow control layer having a porosity less than the porosity of said lubricant distribution layer is formed at a boundary region of the distribution layer to precisely meter the flow of lubricant onto said lubricant application surfaces. The rotating lubricating rolls are arranged in a frame so that the sheet of warp ends is contacted on opposite sides by one each of the rolls. A desired add-on weight of lubricant is applied to the warp ends regardless of the rate of travel through the lubricating rolls by a metering system which delivers a desired volume of lubricant per yard of the warp end sheet.

The method is particularly advantageous for lubricating warp ends which have been dried in two separate sheets so that when the sheets are brought together they are in a generally juxtaposed configuration wherein the sheets contact each other on one side without the warp ends intermeshing with one another. Lubricant is applied to one exposed side of each of the sheets.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The present invention relates to a slashing process and apparatus employed in the slashing process for preparing a loom beam for weaving. Since the slashing process and apparatus referred to as a slasher are conventional and well known in the textile art, only so much of the conventional process and apparatus as are necessary to an understanding of the present invention will be described. The typical slashing process includes withdrawing a number of warp yarn ends from one or more section beams 10 and forming a single warp yarn sheet W in which the warp ends 12 are arranged side by side. The warp yarn sheet W is subjected to a sizing process 14 wherein adhesive size is applied to the individual warp yarn ends. Usually, the adjacent warp yarn ends are separated from one another in a leasing process so that they do not become stuck while dried. The split warp yarn sheet W is passed to a drying process 16 where they are dried. In the case where the individual warp yarns are dried in two or more sheets, the sheets often do not intermesh with each other after drying and lay contacting each other on one side. In this complex configuration (FIG. 7), it becomes difficult to apply a lubricant of the yarns.

Subsequently, the warp yarns are busted into a number of individual sheets 18*a*, 18*b*, 18*c*, and 18*d* corresponding the number of section beam prior to being combed at 20 and wound on the loom beam at 22. It is to be understood, of course, that the method and apparatus of the present invention may be used with a wide variety of slashing processes having variations to the above described process. In accordance with the improvements of the apparatus and method of the present invention, the warp ends are lubricated at 24 on the dry side of the drying process 16.

Figure 3:
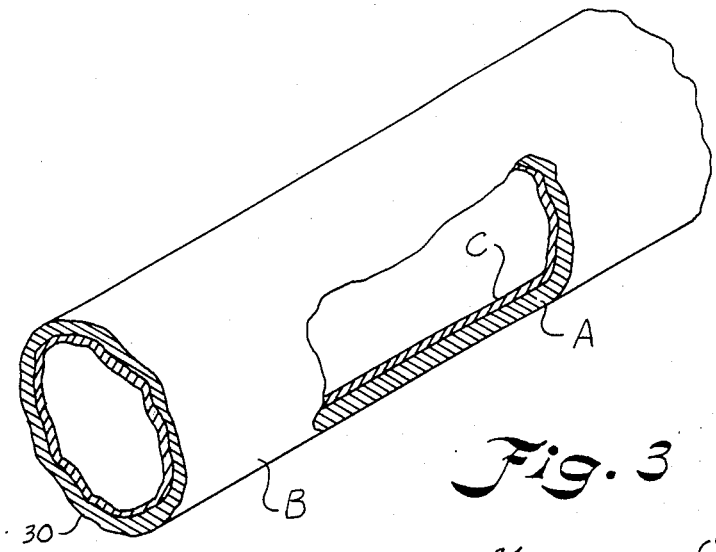
FIG. 3 is a perspective view with parts cut away illustrating a porous lubricating rod utilized according to the present invention.
Figure 4:
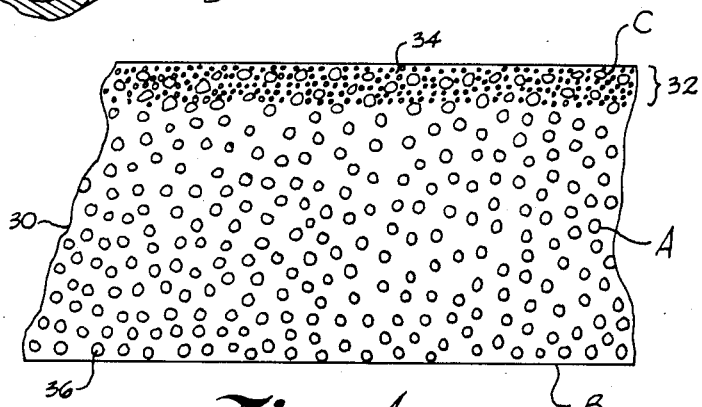
FIG. 4 is a schematic view illustrating the porous distribution layer and flow control membrane for a porous lubricating rod employed in the lubricating method according to the present invention.

Referring now to FIGS. 3 and 4, a porous rod 30 which is advantageously utilized in the method and apparatus of the present invention will be described. It has been found that the porous rod construction which has been developed in the field of ultrafiltration is highly suitable for applying certain types of chemicals in the textile field where separation is controlled and does not occur. Such a rod is disclosed in the above referenced application of which this application is a continuation-in-part, and incorporated herein by reference. In the case of lubrication, it has been found that the illustrated porous rod 30 having a porous lubricant distribution layer A terminating in a continuous exterior lubricant application surface B is highly advantageous to the passage and lubrication of warp yarn ends 12. The surface B is highly suitable for fine denier yarn ends and other yarn ends. On the interior of the porous distribution layer A is a special membrane coating material 34 which absorbs into the distribution layer over a boundary region 32 thereof to define a flow control membrane C that has a calculable rate of flow for a particular lubricant depending upon the physical-chemical properties, such as viscosity, molecular weight, molecular configuration, and the length of the molecular chain of the lubricant. By controlling the volume and pressure of oil supplied to the interior of the porous lubricating rod, the control of the flow through the membrane onto the porous application surface can be precisely controlled in order to apply a precise add-on weight of lubricant to the warp ends.

The porous characteristics of the application surface B is particularly advantageous to the presentation of lubricant to yarn filaments and to the uninterrupted travel of the filaments. The mean dimension and diameter of the surface pores 36 are small compared to the diameter of the yarn filaments passing thereover. For example, the yarn diameter may be on the order of 50–150 microns, the filament diameter may be on the order of 7 to 10 microns, and the pore mean dimension on the order of 1–5 microns.

A suitable porous roll can be had from Carre, Inc. of Seneca, S.C. One having average skill in the art can readily determine the porosity construction of the various layers and surfaces, and the flow control membrane for a desired lubricant having received the teachings of the present invention.

Figure 1:
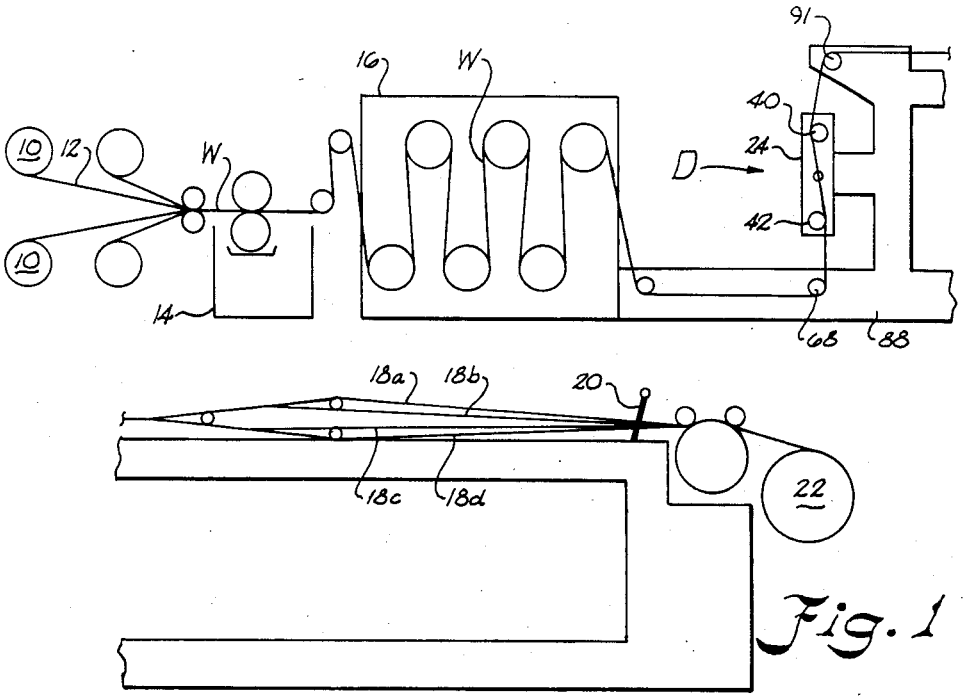
FIG. 1 is a schematic view illustrating a slashing process incorporating the lubricating method and apparatus of the present invention.
Figure 2:
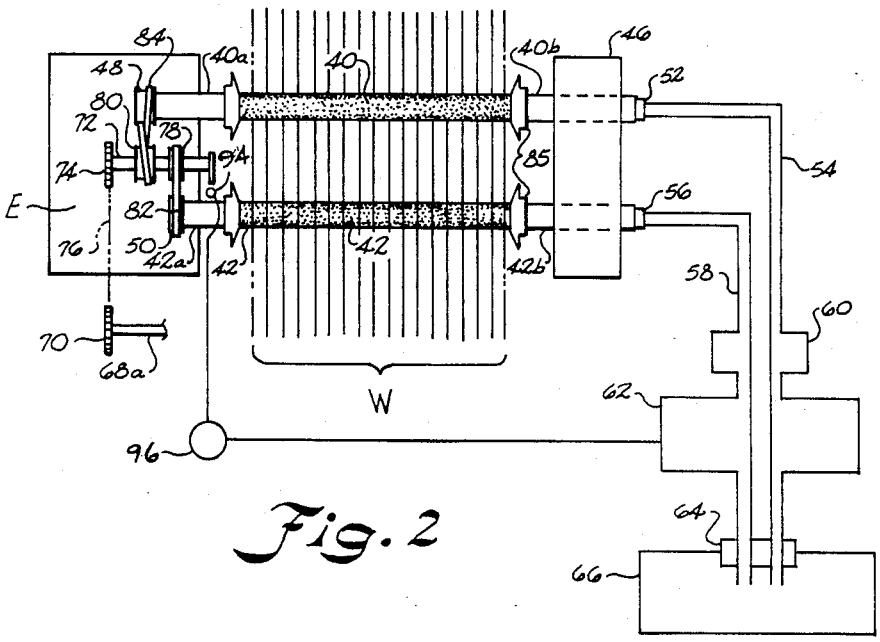
FIG. 2 is a schematic view illustrating the lubricating method and apparatus according to the present invention for use in a slashing process.
Figure 6:
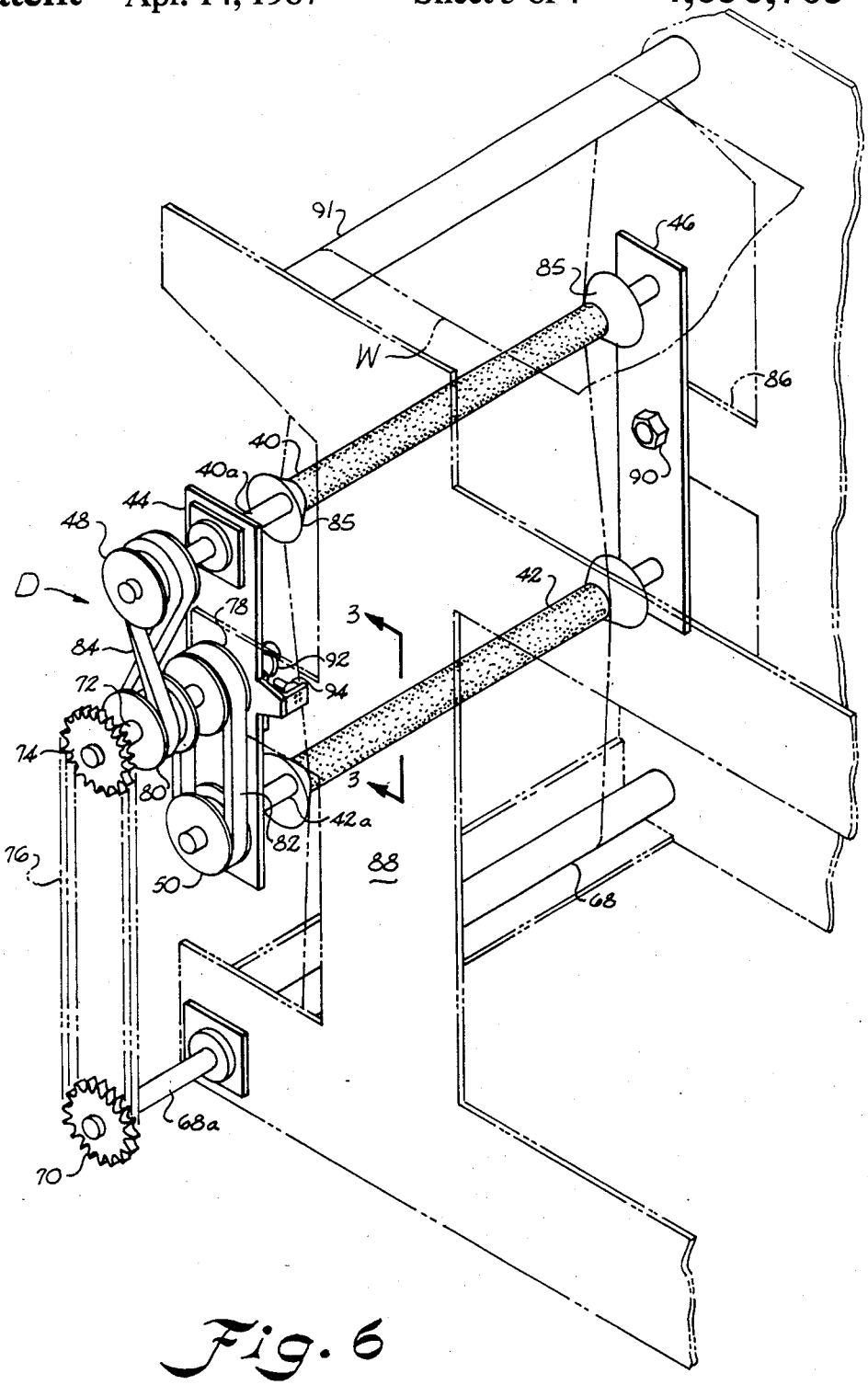
FIG. 6 is a perspective view of part of a slashing process and apparatus in which the lubricating method and apparatus of the present invention is employed.

Referring now in more detail to FIGS. 2 and 6, the apparatus for utilizing the porous rod in a rotating porous rod pair arrangement is illustrated generally at D. The porous rod pair includes a first porous lubricating rod 40 and a second porous lubricating rod 42. The rods are rotatably journaled in a frame having side frames 44 and 46. On one end 40*a*, 42*a* of each porous rod 40, 42 is a shaft extending through the side frame 44. Drive pulleys 48, 50 are affixed to shafts 40*a*, 42*a*, respectively. The other end of each porous lubricating rod includes a hollow shaft 40*b*, 42*b* which is rotatably mounted in the side frame 46. There is a rotary union 52 connecting a fluid delivery line 54 to the hollow shaft 40*b* of lubricating rod 40. There is a rotary union 56 connecting a fluid delivery line 58 to the roller shaft 42*b* of lubricating rod 42. The delivery lines 54, 58 are first connected to a lubricant accumulation reservoir 66. The filter is important since the fine grain of the porous rods best performs when the lubricant is clean. Next, the filtration system 60 is connected to a metering pump 62, preferably of the solenoid piston type where volumeric displacement is known and selected to provide a desired volume of lubricant delivered in response to the rpm of the the rotating rods. Next, there is a reservoir manifold 64 which connects the two lubricant delivery lines between the pumps and a reservoir 66.

There is a guide roll 68 which guides the warp yarn sheet or sheets W through the rotating lubricating rods. A drive means E is provided by a takeoff from the guide roll which drives the rotating rods in response to slasher speed. The travel of the yarn sheet through the slasher causes the guide roll to turn, and there is a power takeoff shaft 68*a* at the end of the guide roll shaft 68. The power takeoff shaft is connected to a drive sprocket wheel 70. There is a rotating shaft 72 journaled in the frame 44 having a secondary drive sprocket 74 to which the rotation of the guide rod 68 is transmitted through a drive chain 76. There are two drive pulleys 78, 80 on the shaft 72. There is a drive belt 82 connecting pulleys 50 and 78. There is a belt 84 connecting pulleys 48 and 80. The belt 82 to the lubricating rod 42 is straight, rotating the rod in a counterclockwise direction. The belt 84 to the rotating rod 40 is twisted to impart a clockwise rotation to it, since it is located on the opposite side of the warp yarn sheet W from rod 42. Thus the rotating rods rotate in the direction of the movement of the warp yarn sheet W. Means for guiding the warp yarn sheet W over the rods 40, 42 is provided by guides 85 tapering towards the application surface B to guide the warp ends over the same.

There are a pair of frame arms 86 for attaching the bracket to a portion of the slasher frame 88 on the dry side of the drying process at 16. A fastening nut 90 is provided to lock and set the side frames 44, 46 at a desired inclination so that the warp yarn sheet contacts the rods 40 and 42 on opposing sheet sides. Alternately, the frame inclination may be set so that the sheet does not contact the lubricating rods at all when the application of the lubricant is not desired. It will be noted that the frame of the rotating rods is vertical in operation which is highly advantageous in saving horizontal floor space in certain installations and for other reasons as well. There is a top guide roll 91 which guides the warp end sheet to the bust rods.

Figure 5:
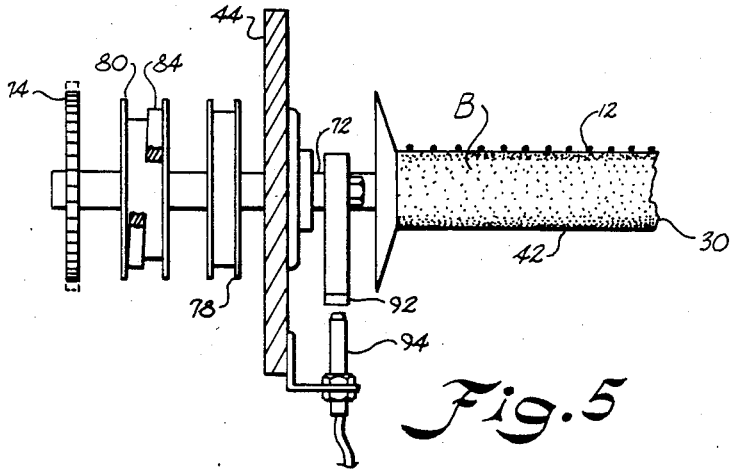
FIG. 5 illustrates a method and apparatus for applying a metered volume of lubricant per yard of warp yarn sheet according to the invention.

There is a proximity switch 94 carried adjacent the shaft 72 as can best be seen in FIG. 5. There is an arcuate-shaped cam actuator member 92 carried for rotation with shaft 72, and a detector 94 carried by side frame 44. The detector 94 detects the presence of the cam actuator and actuates a switch 96 which energizes the solenoid operated piston (not shown) of the metering pump. While any metering system can be utilized, the system described is particularly advantageous for applying a desired volume of lubricant to each yarn of warp ends passing in contact with the rods. For example, the lubricating rods rotate at approximately 120 rpm and the yarn travels at 120 yards/minute. The rods will rotate once per yard of warp ends.

As an example, the arcuate extent of the cam actuator is designed (68 degrees) to actuate switch 94 and thus to energize the solenoid piston a maximum of two times per second when the rods are rotating at 120 rpm. A pump piston can be selected having a volumetric displacement for delivering a desired volume of lubricant to each rod for each yard of the warp end sheet W. The arcuate cam serves as a yard counter since one yard passes the rod upon each revolution. A stroke of the pump is initiated accordingly. At warp movement speeds slower than 120 yards per minute, the pulse width of switch 94 produced by the actuator cam is much longer than the pulse width needed to stroke the pump. The pump thus will always be stroked once per yard at low speeds as well as at the highest design speeds. The desired volume of lubricant per yard of warp is delivered regardless of the rate of travel of the warp below 120 yards/minute.

EXAMPLE

The apparatus and method allows that the appropriate lubricant add-on and metered amount be determined and set, for example, as follows. It is desired to achieve 0.35% add-on of lubricant solids (on the weight of the yarn) to a warp containing 5700 ends of 26/1 yarn. The weight per 1000 yards of this warp can be calculated from well-known formulae which show that, $$\text{Yarn weight/100 yards} = 5700/(840 \times 26) \times 1000$$
$$= 261 \text{ lbs/1000 yds.}$$

The weight of lubricant, then, which is necessary to achieve 0.35% add-on to 261 lbs. of yarn is, $$\text{weight of lubricant} = 0.35\%(261)$$
$$= 0.913 \text{ lbs.}$$

Since the lubricant, a 100% solids solution of highly emulsifiable paraffin oil (e.g. HTC 1906 or Sicolube 1905, available from Hunt Textile Chemical Corp. or AZS Corp of Atlanta, Ga.), weighs approximately 7.5 lbs/gal, the 0.913 lbs of it occupies 0.122 gal. Thus, to achieve the desired lubricant add-on, 0.122 gal must be metered for each 1000 yards of warp that passes by. Since 1 gal is 3.7853 liter, 0.122 gal is 0.4618 l, which is 461.8 cc. Since 1 yard of warp would required (1/1000)×(461.8 cc), or 0.4618 cc of lubricant, the appropriate add-on is achieved by setting the metering pump to deliver 0.46 cc of lubricant each time the yarn counter advances 1 yard. Note that this amount of lubricant is metered regardless of whether the yarn is moving forward rapidly or slowly.

The method of the invention contemplates utilizing the apparatus of rotating lubricating rods described above and the process of preparing a warp beam on a slasher which includes drawing warp yarn ends from a number of section beams, applying size to said warp yarn ends, drying said sized warp yarn ends, and winding said warp yarn ends on a loom beam after busting and combing said warp yarn ends. In particular, the method contemplates utilizing the apparatus on the dry side of the dryer on the slasher in lieu of the conventional kiss roll. In the method, the apparatus is advantageously arranged in a vertical frame so that the warp yarn sheet may pass over and under the rotating lubricating rods. By providing porous lubricating rods having a continuous, uninterrupted surface, and well-defined porous layers including a porous membrane at the boundary region of the porous layer, the lubricant reaching the yarns is controlled in a well-determined manner. The rotating lubricating rolls may be adjusted in their inclination relative to the slasher frame to permit the warp sheet to pass without contacting the lubricating rolls accommodating warp sheets which need not be lubricated.

Figure 7:
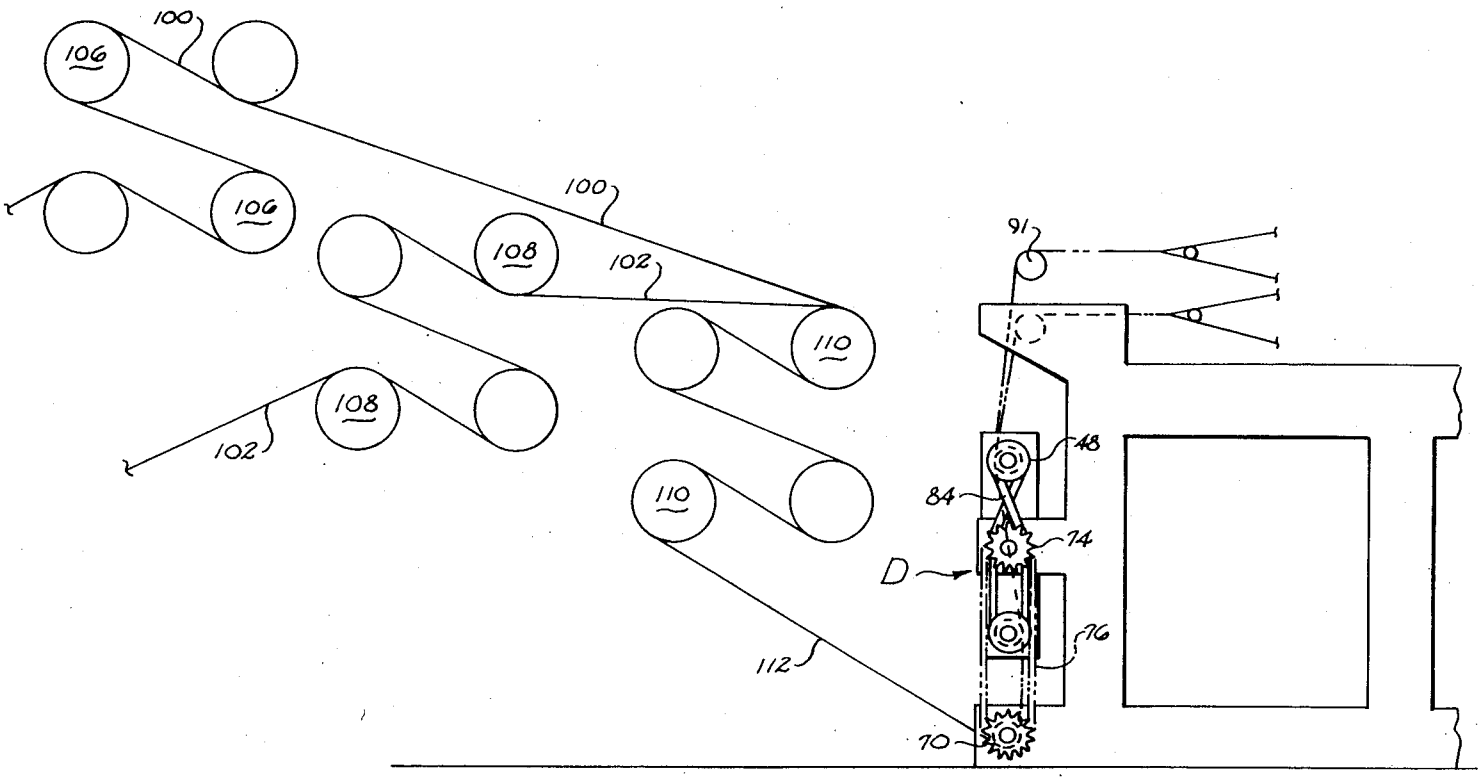
FIG. 7 is a partial schematic and elevation view of a method of lubricating a pair of yarn sheets being processed on a slasher in a complex configuration wherein the yarn sheets are juxtaposed without intermeshing warp ends.

Referring now to FIG. 7, a particularly advantageous form of the method of the present invention is illustrated. In FIG. 7, a pair of warp yarn sheets 100, 102 are illustrated as being dried by sets of different heated cylinders 106, 108. In many applications, warp yarn sheets are passed through the dryer process 16 in a plurality of sheets about separately heated cylinders. The warp yarn sheets are then brought back together by passing around cylinders 110 before being delivered to the guide roll 68 on the slasher frame. In the above described drying process, a complex configuration results among the warp yarn sheets leaving the dryer. The warp ends in the warp yarn sheet 100 tend to stick together side-by-side when dried. Likewise, the warp ends in the warp yarn sheet 102 are stuck together side-by-side in the warp sheet. Thus, each warp sheet is generally in the form of a solid sheet when leaving the dryer. In this configuration, the warp ends of contacting warp sheets do not intermesh with one another, but merely contact one another in a juxtaposed configuration at 112. In the case of two warp yarn sheets, the inside surfaces contact one another while the outside surfaces of each warp yarn sheet is exposed. In the conventional methods of applying lubricants, only one side of the warp ends in the bottom warp sheet would receive any lubricant. The opposite side of the warp ends on the bottom sheet would receive no lubricant. The warp ends of the top yarn sheet, in a horizontal configuration, would receive no lubricant at all. In accordance with the method of the present invention, this complex configuration of warp yarn sheets receive some lubricant on at least one side of each warp sheet. As the juxtaposed warp yarn sheets pass in a serpentine manner through the rotating lubricating rod, the exposed side of one warp sheet will contact rotating rod 40 and the exposed side of the other warp yarn sheet will contact the lubricating rod 42. The warp ends of each warp yarn sheet will receive some lubricant. After the warp yarn sheets are busted to separate the side-by-side warp ends into separate sheets, and wound upon the loom beam, the lubricant tends to migrate among the wound warp ends in a more even distribution. Thus it has been found that this method of sizing warp yarn sheets in the afore-described complex configuration results in effective lubricating of the warp ends.

The rotating lubricating rod apparatus are particularly suitable for applying a highly emulsified type of spin finish oil to the warp after drying and prior to the bust. The lubricant is applied to both sides of the warp ends prior to bust. The continuous rotation of the rods maintains the lubricant application surface clean and smooth, and an even distribution of the exuded lubricant is applied. It has been found that according to the present invention that the coefficient of friction of the warp ends is reduced approximately thirty percent when the apparatus and method of the present invention are employed, with or without size solutions containing wax. By eliminating wax from the size formula, a probable decrease in the add-on requirements for the size will occur since compensation for degradation of the size film caused by the presence of wax will no longer be necessary. Savings will be realized from using less size, eliminating wax, and having greater weaving efficiency. In addition, the lubricating method and apparatus of the present invention produce a well-lubricated warp from which the lubricant can be more easily and more economically removed during the sizing.

Application of fluids to sheets of material may also be had by the invention where the porous nature and physical characteristics of the application surface of the rod and metering characteristics of the porous layers are expedients to the application of the fluid to the material.

While a preferred embodiment of the invention has been described using specific terms, such description is for illustrative purposes only, and it is to be understood that changes and variations may be made without departing from the spirit or scope of the following claims.

What we claim is:

1. In a slashing process of preparing a loom beam for weaving on a slasher, which includes the steps of forming a sheet of individual warp yarn ends from at least one warp section beam wherein said ends are arranged individually side by side, passing said warp yarn sheet through a sizing process to place sizing on said individual warp ends, drying said sized warp ends on said warp yarn sheet, busting said warp yarn sheet which has been dried into a plurality of warp yarn sheets corresponding to the number of warp section beams from which said warp yarns are withdrawn, and winding said warp yarn ends onto a single loom beam, wherein the improvement comprises lubricating said warp yarns after drying and before busting by arranging a pair of porous lubricating rods including a first rotating lubricating rod and a second rotating lubricating rod, passing said dried warp yarn sheet under said first rotating lubricating rod and over said second rotating lubricating rod whereby the opposite sides of said warp yarn sheet are contacted by at least one of said rotating lubricating rods, and providing each of said lubricating rods in the form of a porous hollow rod having an inner porous lubricant distribution layer terminating in a generally smooth outer continuous lubricant application surface which contacts said warp yarn ends for lubrication and facilitates smooth passage of said individual warp yarn ends over said application surface without snagging and breakage; an inner flow control membrane formed at a boundary region of said porous distribution layer; and said flow control membrane having a porosity not greater than the porosity of said lubricant distribution layer to meter the flow of lubricant onto said lubricant application surface.

2. The method of claim 1 including arranging said first and second rotating lubricating rods generally in a vertical plane.

3. The method of claim 2 comprising arranging said pair of rotating rolls on an adjustable frame so that the plane of said rods may be inclined so that said warp yarn sheet passes between said pair of rods in said inclined plane out of contact with said rods.

4. The method of claim 1 including metering the amount of lubricant delivered to said rotating rolls to apply a desired amount of add-on weight to said warp ends.

5. The method of claim 1 wherein said drying process includes drying said warp yarns in at least two separate warp yarn sheets, and said method includes:

bringing said sheets together in a generally juxtaposed configuration wherein said sheets contact each other on one side generally without said warp yarns intermeshing with one another leaving one exposed side on each of said sheets;

passing said juxtaposed warp yarn sheets through said pair of lubricating rods; and contacting the exposed sides of said juxtaposed sheets with said rotating lubricating rods.

6. The method of claim 1 including metering a desired volume of lubricant to an interior of said porous rods per yard of warp ends regardless of the speed of said warp sheet traveling past said rods.

7. The method of claim 1 wherein said porous application surface includes pores having a mean dimension which is smaller than the mean diameter of the yarn ends passing over said porous surface.

8. In a slashing process for preparing a loom beam for weaving on a slasher of the type which includes forming a warp yarn sheet of individual warp ends arranged generally side by side, subjecting said warp yarn sheet to a sizing process wherein sizing is applied to said warp ends, drying said sized warp ends, and winding said warp ends upon a loom beam, said method comprising:

providing a pair of rotating lubricating rods on a frame;

arranging said pair of lubricating rods on said slasher generally in a vertical plane after said drying process;

rotating said porous lubricating rods at a rotational speed proportional to the speed of said slasher;

passing said warp yarn sheet over a first of said lubricating rods and under a second of said lubricating rods;

metering a desired amount of lubricant and delivering said metered amount of lubricant to said interior of said lubricating rods;

the metering of said lubricant being in response to the operational speed of said slasher; and applying a desired percentage of add-on weight of said lubricant to said warp yarns.

9. The method of claim 8 including providing each of said lubricating rods in the form of a porous hollow rod having a porous lubricant distribution layer terminating in a continuous lubricant application surface; an inner flow control membrane formed at a boundary region of said porous distribution layer; and said flow control membrane having a porosity not greater than the porosity of said lubricant distribution layer to meter the flow of lubricant onto said lubricant application surface.

10. The method of claim 8 wherein said drying process includes drying said warp yarns in at least two separate warp yarn sheets, and said method includes:

bringing said sheets together in a generally juxtaposed configuration wherein said sheets contact each other on one side generally without said warp yarns intermeshing with one another leaving one exposed side on each of said sheets;

passing said juxtaposed warp yarn sheets through said pair of lubricating rods; and contacting the exposed sides of said juxtaposed sheets with said rotating lubricating rods.

* * * * *